US009707149B1

(12) United States Patent
Juarez

(10) Patent No.: US 9,707,149 B1
(45) Date of Patent: Jul. 18, 2017

(54) FOLDING WALKER

(71) Applicant: Francisco Juarez, Williams, AZ (US)

(72) Inventor: Francisco Juarez, Williams, AZ (US)

( * ) Notice: Subject to any disclaimer, the term of this patent is extended or adjusted under 35 U.S.C. 154(b) by 0 days.

(21) Appl. No.: 15/251,465

(22) Filed: Aug. 30, 2016

Related U.S. Application Data

(62) Division of application No. 15/183,429, filed on Jun. 15, 2016.

(51) Int. Cl.
*A61H 3/04* (2006.01)
*A61H 3/00* (2006.01)

(52) U.S. Cl.
CPC ..... *A61H 3/04* (2013.01); *A61H 3/00* (2013.01); *A61H 2201/0161* (2013.01)

(58) Field of Classification Search
CPC ..... A61H 3/00; A61H 2201/0161
USPC ..... 135/67, 74
See application file for complete search history.

(56) References Cited

U.S. PATENT DOCUMENTS 2,732,004 A * 1/1956 Forbes ..... A61H 3/04 482/67
2,817,387 A * 12/1957 Blake ..... A61H 3/00 135/67
3,421,529 A * 1/1969 Vestal ..... A61H 3/00 135/67
3,516,425 A * 6/1970 Rigal ..... A61H 3/00 135/67
4,253,478 A * 3/1981 Husa ..... A61H 3/02 135/68
4,481,965 A * 11/1984 Watkins ..... A61H 3/00 135/67
4,729,395 A * 3/1988 Adamson ..... A61H 3/00 135/67
4,995,412 A * 2/1991 Hirn ..... A61H 3/00 135/67
5,261,682 A * 11/1993 Chuang ..... A61H 3/04 188/1.12
5,277,438 A * 1/1994 Chuang ..... A61H 3/04 135/67
5,509,152 A * 4/1996 Kippes ..... A61G 7/10 135/67
5,782,256 A 7/1998 Bradley
6,206,019 B1 * 3/2001 Horvitz ..... A61H 3/00 135/66
7,373,942 B1 5/2008 Yeager
8,746,637 B2 6/2014 Liu
8,789,547 B1 7/2014 Reda
9,228,601 B2 * 1/2016 Fang ..... F16B 7/042
2007/0169308 A1 7/2007 Chiu
(Continued)

*Primary Examiner* — Noah Chandler Hawk
(74) *Attorney, Agent, or Firm* — Schmeiser, Olsen & Watts LLP

(57) ABSTRACT

A folding walker is provided, including methods of using the folding walker. The folding walker includes two side members. Each of the side members includes a leg assembly; a handle assembly; and two first hinges coupled between the leg assembly and the handle assembly. The folding walker also includes a front member. The front member includes a horizontal member having a first portion and a second portion; and a second hinge coupled between a first end of the first portion and a first end the second portion, wherein a second end of the first portion is rotatably coupled to one side member and a second end of the second portion is rotatably coupled to the other side member.

3 Claims, 12 Drawing Sheets

(56) References Cited

U.S. PATENT DOCUMENTS

| | | | | |
|---|---|---|---|---|
| 2008/0121258 | A1* | 5/2008 | Lin | A61H 3/00<br>135/67 |
| 2011/0192942 | A1* | 8/2011 | Liu | A45B 9/00<br>248/166 |
| 2014/0109943 | A1* | 4/2014 | Fang | A61H 3/00<br>135/67 |

* cited by examiner

FOLDING WALKER

CROSS REFERENCE TO RELATED APPLICATION[S]

This application is a divisional of the earlier U.S. Utility patent application entitled "FOLDING," Ser. No. 15/183,429, filed Jun. 15, 2016, the disclosure of which is hereby incorporated entirely herein by reference.

BACKGROUND OF THE INVENTION

Technical Field

This invention generally relates to a walker and more particularly to a walker that folds for storage.

State of the Art

As of 2014, over six million Americans utilized mobility assist devices such as canes, crutches, and walkers, to assist with balance, stability, and ambulation. Walkers have changed little in design since their introduction in the 1950s. The traditional "Zimmer frame" walker features four legs supporting a frame which the user steps into and grasps with each hand, lifting the device slightly from the ground and moving it forward. The user, while grasping handles of the device for support, lifts the frame slightly and moves it forward, then takes a step forward while leaning slightly on the handles of the frame, as necessary for balance and support.

Although the Zimmer frame walker is simple in design, relatively inexpensive, and highly effective, there are problems with the device. The frame forms a wide "U" shape which the user steps into, such that the user is encircled by the frame on three sides. The frame, therefore, is somewhat large and bulky. This creates challenges with fitting the frame into the back seat or trunk of a vehicle, and when storing the device at home. Further still, walkers that do fold are still bulky and difficult to store.

Accordingly, what is needed is an improved walker that is foldable and collapsible to be easily transported and stored.

SUMMARY OF THE INVENTION

The foregoing application describes a walker that is foldable and collapsible. The ability of this walker to both fold and collapse will allow a user to store and transport the walker more easily due to its decreased bulk upon folding and collapsing. Because the walker will be able to fit into any vehicle trunk, backseat, or commercial vehicle storage space such as an airline overhead compartment, a user will no longer be inhibited from traveling due to the need to transport a walker. Additionally, a user may conveniently store the walker in any closet or under a bed while at home. The easy-to-use nature of this walker also means that anyone in need of a walker will be able to use this device, and benefit from its enhanced design and functionality.

Embodiments of the present invention include a folding walker, a method of preparing a folding walker for use, and a method of preparing a folding walker for non-use.

An embodiment includes a folding walker comprising: two side members, each side member comprising: a leg assembly; a handle assembly; and two first joints coupled between the leg assembly and the handle assembly; and a front member comprising: a horizontal member having a first bar and a second bar; and a second joint coupled between a first end of the first bar and a first end the second bar, wherein a second end of the first bar is rotatably coupled to one side member and a second end of the second bar is rotatably coupled to the other side member.

An embodiment includes a method of using a folding walker, the method comprising: unfolding two leg assemblies wherein two first joints are in a fully open position; sliding a first brace from an open position to a closed position to releasably retain the first joints in a fully open position; unfolding a horizontal member, wherein a second joint is in a fully closed position; and sliding a second brace from an open position to a closed position to releasably retain the second joints in a fully closed position.

Another embodiment includes a folding walker comprising: two side members, each side member comprising: a leg assembly; a handle assembly; two first joints coupled between the leg assembly and the handle assembly; a first brace comprising two first sleeves slidably coupled to the leg assembly and the handle assembly; and a first strut coupled between the two first sleeves, wherein the first brace releasably retains the two first joints in a fully open position; and a front member comprising: a first horizontal member having a first bar and a second bar; a second horizontal member having a first bar and a second bar; two second joints, wherein: one second joint is coupled between a first end of the first bar and a first end the second bar of the first horizontal member, wherein a second end of the first bar of the first horizontal member is rotatably coupled to a first side member and a second end of the second bar of the first horizontal member is rotatably coupled to a second side member; and the other second joint is coupled between a first end of the first bar and a first end the second bar of the second horizontal member, wherein a second end of the first bar of the second horizontal member is rotatably coupled to the first side member and a second end of the second bar of the second horizontal member is rotatably coupled to the second side member; and a second brace comprising a second sleeve slidably coupled to a horizontal member, wherein the second brace releasably retains the second hinge in a fully open position.

The foregoing and other features and advantages of the invention will be apparent to those of ordinary skill in the art from the following more particular description of the invention and the accompanying drawings.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF EMBODIMENTS OF THE INVENTION

As noted herein above, embodiments of the present invention relate to walkers for persons who need assistance with ambulation. Specifically, the invention relates to walkers which collapses and folds for storage. Some commercially available walkers have an articulated front piece which folds, allowing a user to partially collapse the walker by bringing the side members inward toward one another. This folding capability facilitates transport and storage. The existing walkers, however, is only compressed in width, and retains the same height, thus the existing walkers are flattened width-wise but still have a large footprint and require a correspondingly large area for storage. A novel solution to this problem is provided in the disclosure of embodiments of this instant invention, which describe a foldable walker that folds in two separate, orthogonal planes, wherein both the width and the height of the walker are compressed, greatly facilitating transport and storage over the prior art. Structural sections of the folding walker are coupled together at joints which may flex, rotate, or otherwise allow movement of the sections with respect to one another to allow folding and collapsing of the walker, as described in detail herein below. The joints of the folding walker are re-enforced by joint braces which slide between two positions. A first joint brace position covers the underlying joint, reinforcing and locking the joint in a fully-open position. A second joint brace position uncovers the joint, wherein the joint may flex, rotate, or the like such that the joint may move to a fully closed position.

Figure 1A:
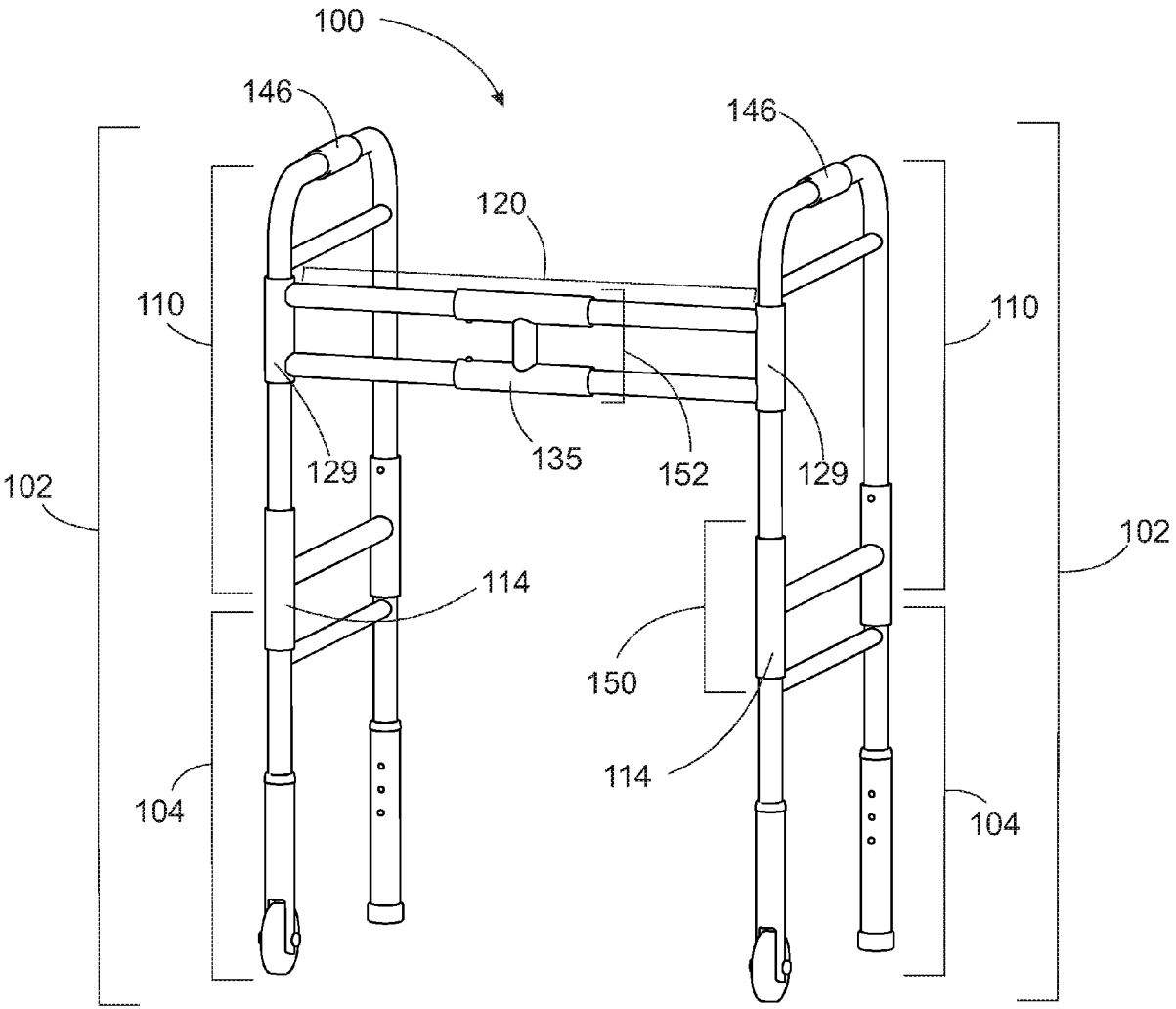
FIG. 1*a* is a perspective view of a foldable walker with joint braces in a closed position.
Figure 1B:
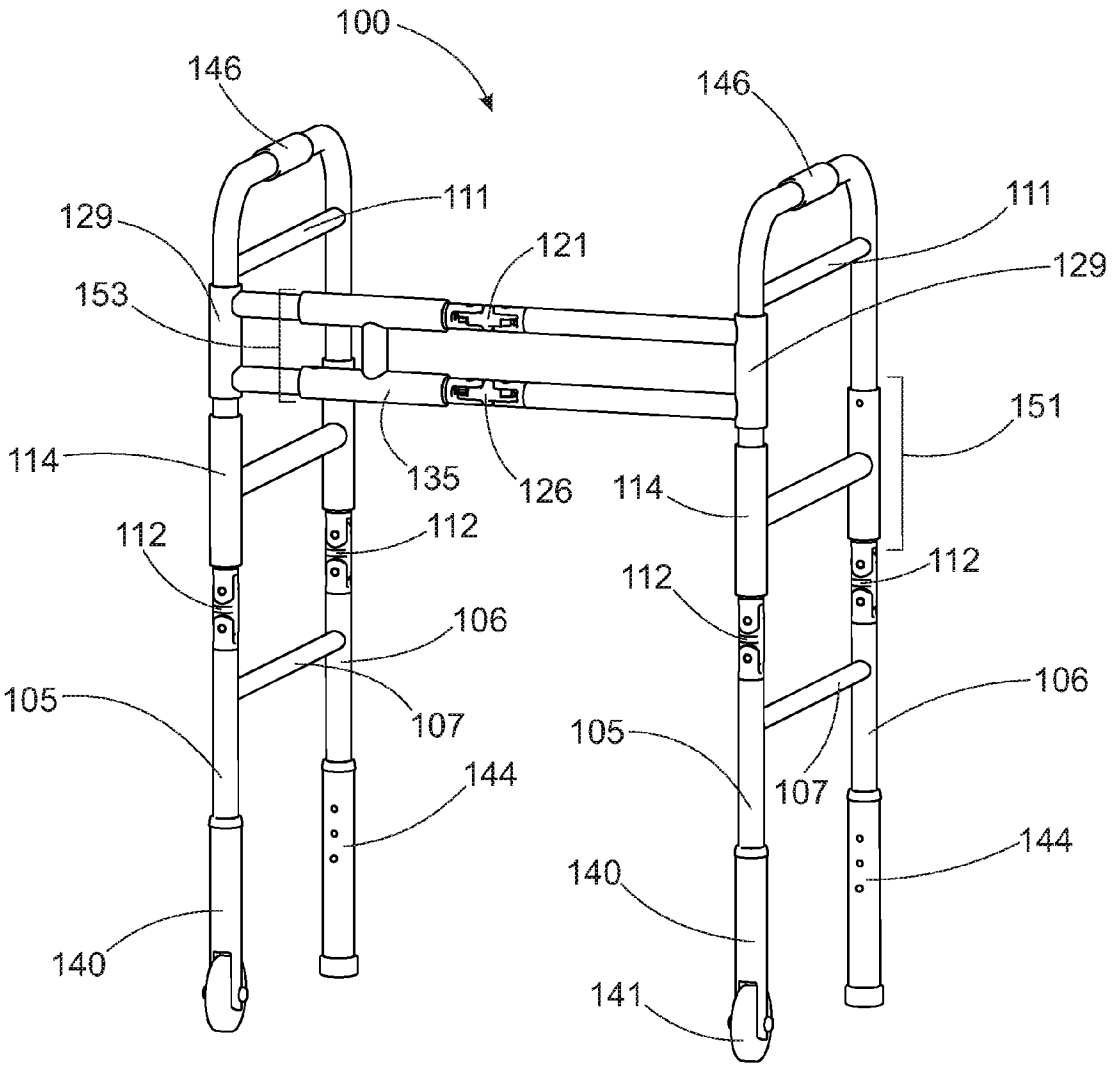
FIG. 1*b* is a perspective view of a foldable walker with joint braces in an open position.

FIG. 1*a* is a perspective view of a foldable walker with joint braces in a closed position 150 and 152, and FIG. 1*b* is a perspective view of a foldable walker with joint braces in an open position 151 and 153.

FIG. 1*a* and FIG. 1*b* show a walker 100. Walker 100 comprises a side member 102 and a front member 120. Two side members 102 are hingedly coupled to front member 120 at a third joint 129 (See FIG. 1*b*) to form walker 100. Each side member 102, in turn comprises a leg assembly 104 and a handle assembly 110. Leg assembly 104 is coupled to handle assembly 110 at a first joint 112 (See FIG. 1*b*) which is covered by a first brace 114 in the embodiment shown in FIG. 1*a*. Leg assembly 104 and handle assembly 110 are formed, in some embodiments, of hollow tubing.

FIG. 1*a* and FIG. 1*b* also show a first brace 114 and a second brace 135. First brace 114 is slidably coupled to side member 102 proximate to two first joints 112, wherein first brace 114 covers a first joint 112 at closed position 150, as shown in FIG. 1*a*, and exposes first joint 112 at open position 151, as shown in FIG. 1*b*. In some embodiments, including the embodiment shown in FIG. 1*a* and FIG. 1*b*, first brace 114 slidably moves to cover or uncover two first joints 112. Similarly, second brace 135 is slidably coupled to front member 120, wherein second brace 135 covers a second joint 126 when second brace 135 is in the closed position 152, and wherein second brace 135 uncovers second joint 126 when second brace 135 is in the open position 153 (See FIGS. 1*a* and 1*b*). In some embodiments, including the embodiment shown in FIG. 1*a* and FIG. 1*b*, second brace 135 slidably moves to cover or uncover two second joints 121 and 126, however this is not meant to be limiting. Some embodiments of walker 100 comprise a single second joint 126. In some embodiments, walker 100 comprises two second joints, however second brace 135 slidably covers two second joints 126 as in FIG. 1*b*.

FIGS. 1*a* and 1*b* show some additional elements of leg assembly 104 of walker 100. Leg assembly 104, in some embodiments, comprises a front 105 and a rear leg 106. In some embodiments wherein the height of walker 100 is adjustable by the user, front leg 105 additionally comprises a front leg extension 140 and rear leg 106 comprises a rear leg extension 144. Front leg extension 140 and rear leg extension 144 are adjustably coupled to front leg 105 and rear leg 106, respectively. FIG. 1*b* also shows a wheel 141 coupled to front leg extension 140. In some embodiments lacking front leg extension 140, (not shown), wheel 141 is coupled directly to front leg 105. A hand grip 146 is coupled to handle 110 in some embodiments. Hand grip 146 facilitates handling of walker 100 by a user by providing a secure high-friction structure for the user to grasp, lift, push, and lean on walker 100, decreasing the risk of the user's hands slipping on a lower-friction surface, such as bare metal, smooth plastic, or the like. The embodiments shown in the figures depict hand grip 146 as a separate structure coupled to handle 110. This is by way of illustration and example; it is not meant to be limiting. In some embodiments, hand grip 146 comprises roughened or otherwise textured material comprising a section of the surface of tubing forming handle 110, such as a knurled rubber grip, for example.

A first cross member 107, as shown in FIG. 1*b*, is coupled to front leg 105 and back leg 106, in some embodiments. First cross member 107 stabilizes leg assembly 104 (see FIG. 1*a*) by adding lateral rigidity. Additionally, in some embodiments, a top cross member 111 stabilizes and contributes lateral rigidity to handle assembly 110. Second cross member 111 is coupled to handle assembly 110 above first brace 114, in some embodiments.

Figure 2:
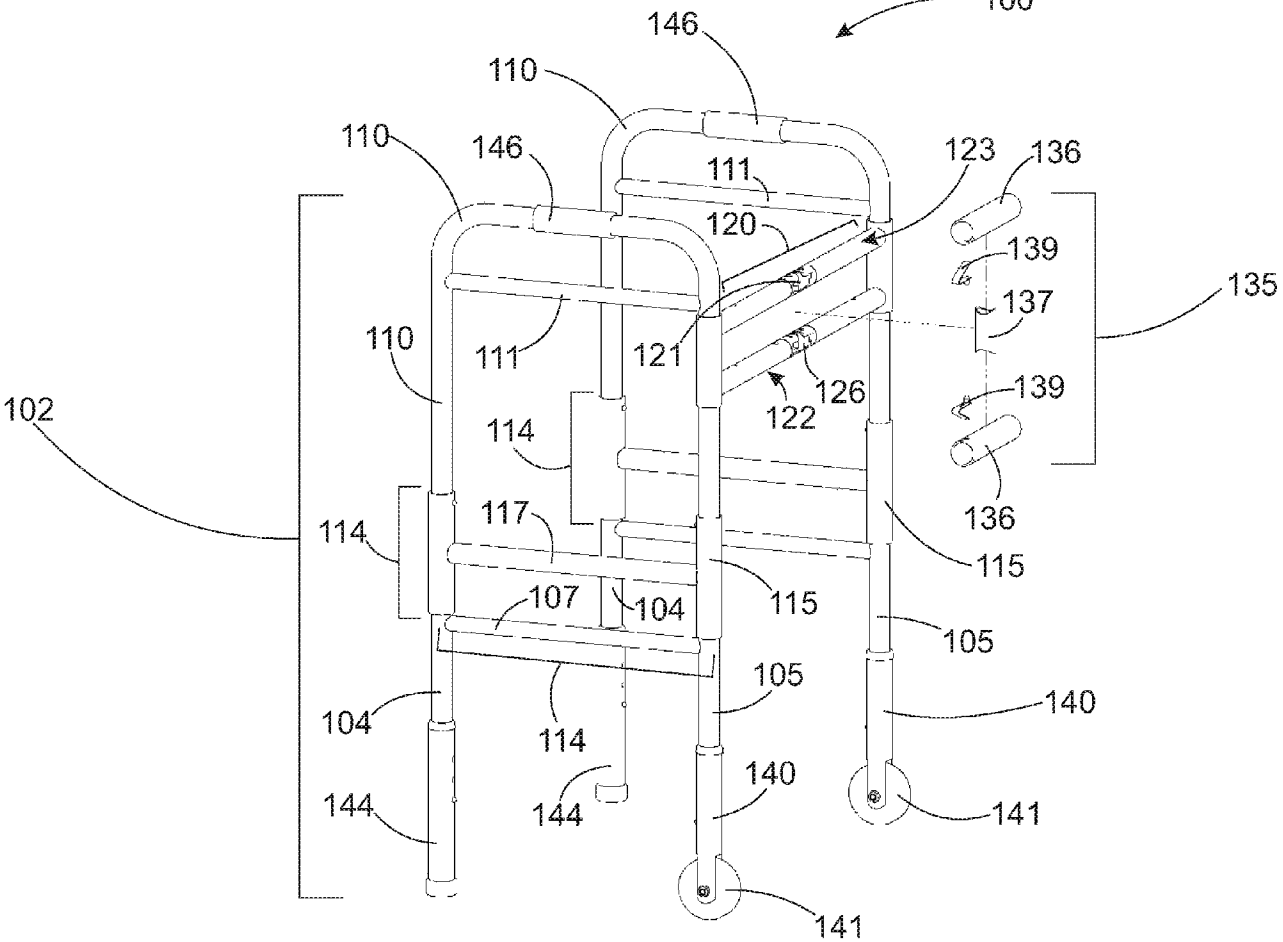
FIG. 2 is an additional perspective view of a foldable walker including an exploded view of a second brace.

FIG. 2 is an additional perspective view of a foldable walker including an exploded view of second brace 135. As shown in FIG. 2, second brace 135 comprises a second sleeve 136. In the embodiment shown, and in some other embodiments, second brace 135 additionally comprises a second strut 137 and an additional second sleeve 136, wherein second strut 137 is coupled to each second sleeve 136. Second sleeve 136 is slidably coupled over a horizontal member 121. Horizontal member 121 comprises a first portion 122 and a second portion 123 hingedly coupled at second joint 126. In some embodiments, front member 120 comprises two horizontal members 121, wherein second strut 137 provides rigidity and strength between two second sleeves 136 of second brace 135 slidingly coupled to the two corresponding horizontal members 121.

Figure 3A:
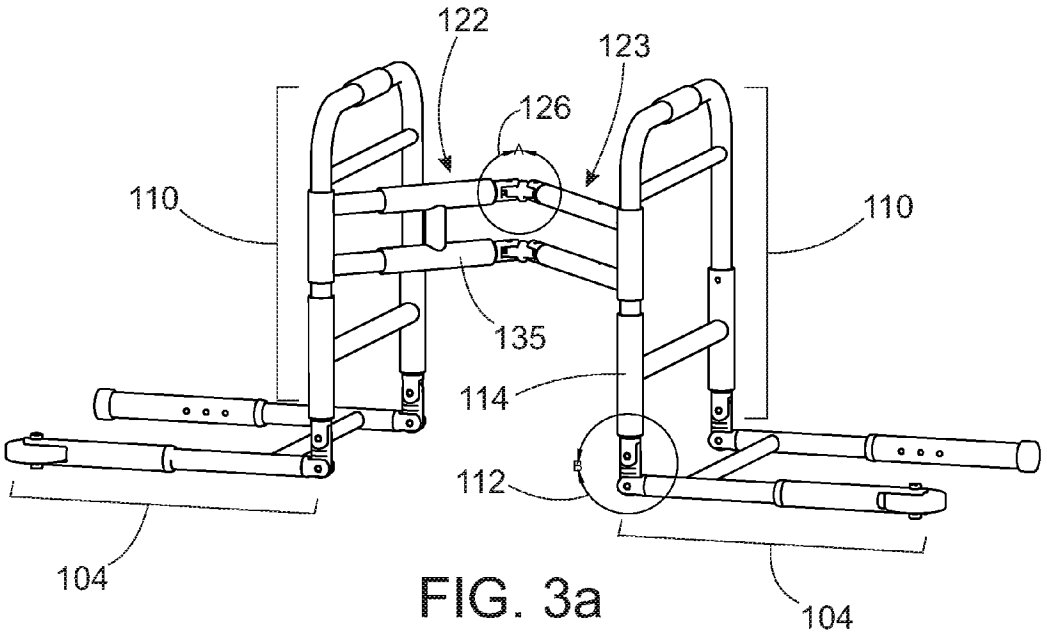
FIG. 3*a* is a perspective view of a foldable walker in a partially folded configuration.

FIG. 3*a* is a perspective view of a foldable walker in a partially folded position. First, as shown in FIG. 3*a*, each first joint 112 rotates from a fully open position to a partially closed position, wherein each side member 102 (FIG. 1*a*) rotates at first joint 112 with leg assembly 104 rotating upward toward handle assembly 110. Additionally, second joint 126 rotates to allow first portion 122 and second portion 123 of front member 120 (FIG. 1*a*) to rotate toward one another, which results in each handle assembly 110 of the two side members 102 (FIG. 1*a*) moving together, as shown by FIG. 3*a*.

Figure 3C:
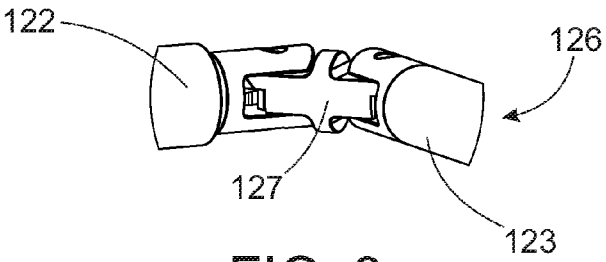
FIG. 3*c* is an enlarged perspective view of a second joint.
Figure 3B:
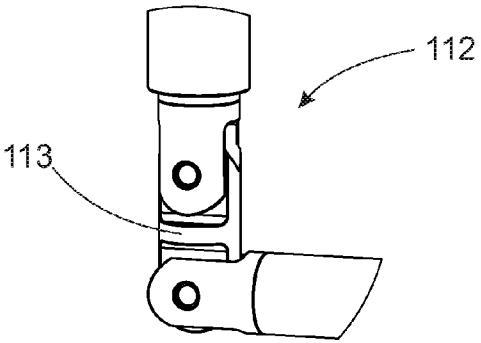
FIG. 3*b* is an enlarged perspective view of a first joint.

FIG. 3*b* is an enlarged perspective view of a first joint 112. As shown in FIG. 3*a*, first joint 112 comprises a first hinge 113 coupled to leg assembly 104 and handle assembly 110. Hinge 113, in some embodiments, is a hinge similar to the embodiment shown in FIG. 3*a*. This is by way of example and is not meant to be limiting. Hinge 113 is of any suitable design known in the art for hingedly coupling two structural members, such as leg assembly 104 and handle assembly 110, together (See FIG. 1*a*).

FIG. 3*c* is an enlarged perspective view of a second joint 126. As shown in FIG. 3*c*, second joint 126 comprises a second hinge 127 coupled to a first end of first bar 122 and a first end of second bar 123. Second hinge 127, in some embodiments, is a hinge similar to the embodiment shown in FIG. 3*c*. This is by way of example and is not meant to be limiting. Second hinge 127 is of any suitable design known in the art for hingedly coupling two structural members, such as first bar 122 and second bar 123 of horizontal member 120, together (FIG. 1*a*).

Figure 4A:
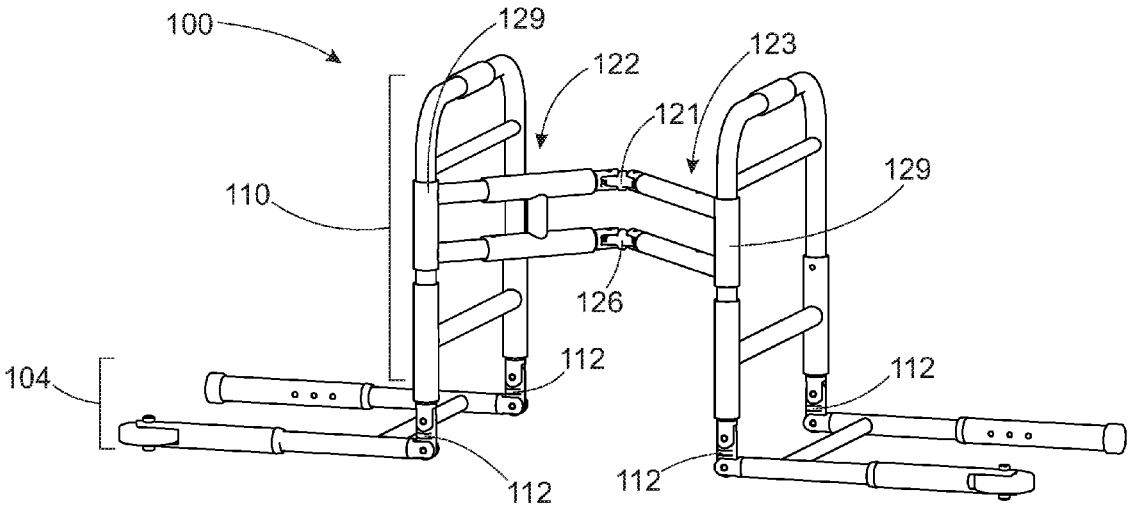
FIG. 4*a* is an additional perspective view of a foldable walker in a partially folded configuration.

FIG. 4*a* is an additional perspective view of a foldable walker in a partially folded position. As shown by FIG. 4*a*, walker 100 is partially folded, shortening both the length of front member 120 (FIG. 1*a*) and the length of each side member 102 (FIG. 1*a*). This is an intermediate position, approximately midway between a fully open position and a fully folded position of walker 100.

Figure 4B:
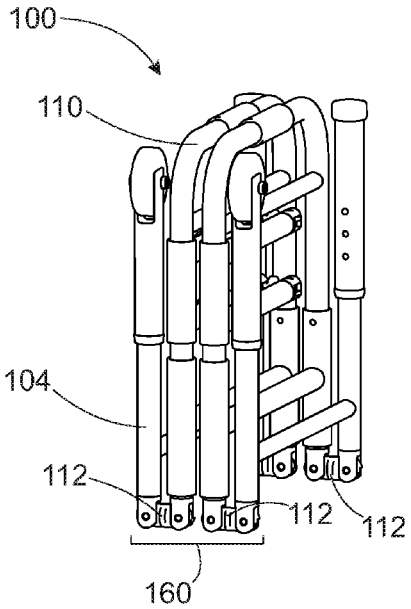
FIG. 4*b* is a perspective view of a foldable walker in a fully folded configuration.

FIG. 4*b* is a perspective view of a foldable walker in a fully folded position or in a storage position 160. As shown in FIG. 4*b*, each leg assembly 104 in the fully folded position has been and rotated upward to rest proximate and substantially parallel to a corresponding handle assembly 110. Additionally, each handle assembly 110 has been brought together in opposition by rotation of second joint 126 and rotation of third joint 129 (FIG. 1*a*), wherein the front member 120 (FIG. 1*a*) is folded with the first bar 122 and the second bar 123 substantially parallel between the handle assemblies 110 when in the fully folded position. Walker 100 is, therefore, now in storage position 160 and may be easily placed in a trunk, a back seat, or a passenger side seat of a user's vehicle for transport, or stored in a closet or similar storage area.

Figure 5A:
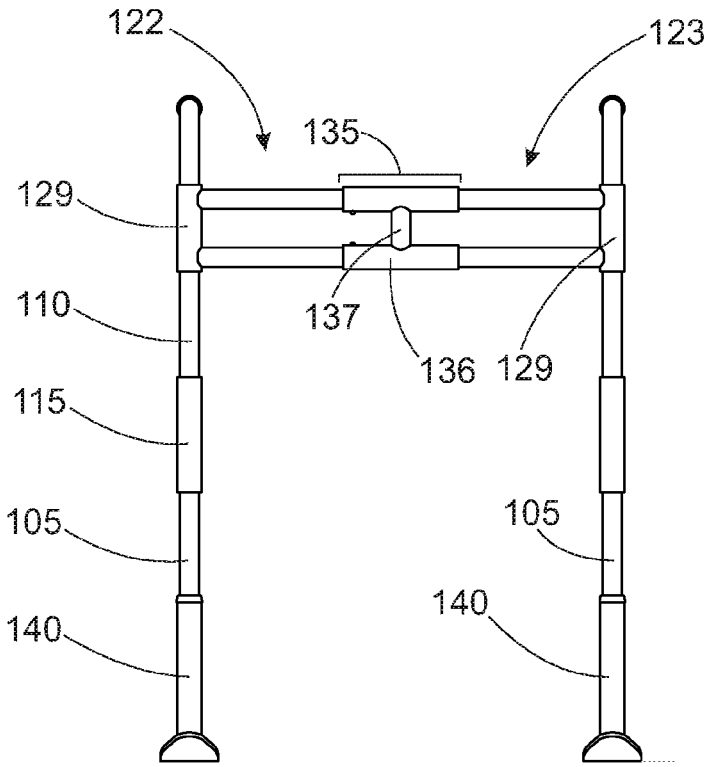
FIG. 5*a* is a front view of a foldable walker.
Figure 5B:
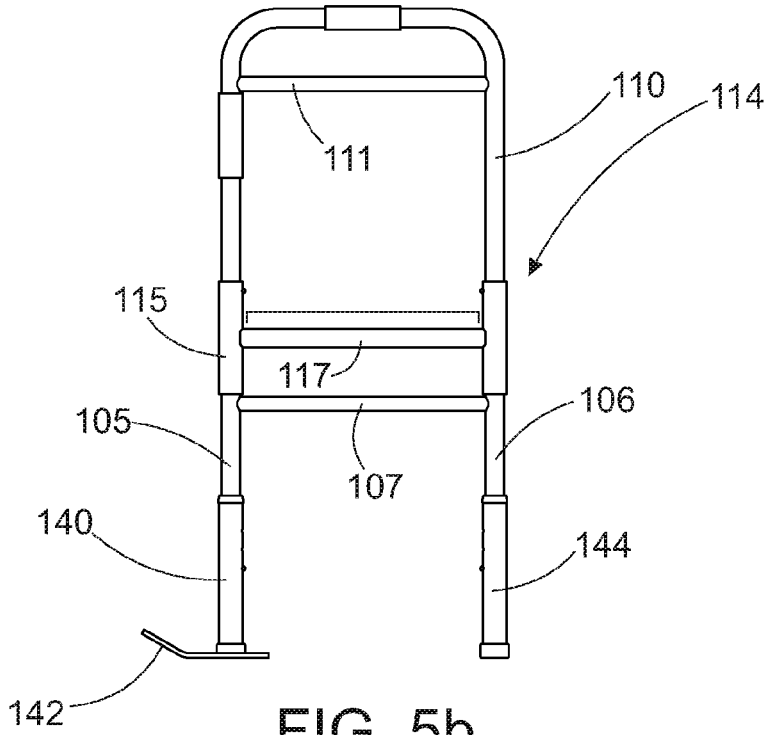
FIG. 5*b* is a left-side view of a foldable walker.

FIGS. 5*a* and 5*b* is a front and side view of a foldable walker 100. As shown in FIG. 5*a*, walker 100 is fully open. Moreover, moveable sleeves 115 with strut 117 coupled between moveable sleeves 115 of first brace 114 cover first joints 112 (FIG. 1*b*), locking first joints 112 in a fully open position, stabilizing side 102, and adding rigidity to the side 102. Similarly, second sleeves 136 with strut 137 coupled between sleeves 136 of second brace 135 cover two second joints 126 (FIG. 1*b*), stabilizing and adding rigidity to front member 120. In this embodiment, the walker 100 includes an optional front leg ski extension 142. Optional front leg ski extension 142 allows a user of walker 100 to slide walker 100 forward on a smooth surface, such as carpet, tile, linoleum, or similar smooth, indoor surface or on outdoor pavement, dirt, grass, and similar outdoor, smooth surfaces. Wherein a user can slide walker 100 forward, the user does not need to lift walker 100 from the ground when moving forward, facilitating the use of walker 100 by persons with a better sense of balance. Wheel 141 (see FIG. 1*a*) accomplishes a similar function, and may be more suited to use on smooth, rough, or irregular surfaces, such as pavement, gravel, and similar outdoor surfaces. Walker 100 equipped with a wheels 141 coupled to each front leg extension 140 may also be used indoors. FIG. 5*b* additionally shows first cross member 107 stabilizing leg assembly 104 and second cross member 111 stabilizing handle assembly 110.

Figure 5C:
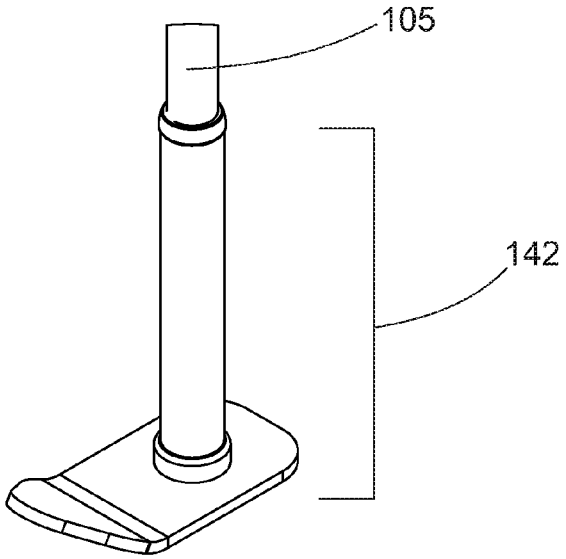
FIG. 5*c* is an enlarged view of a front-leg extension of a foldable walker fitted with a ski.
Figure 5D:
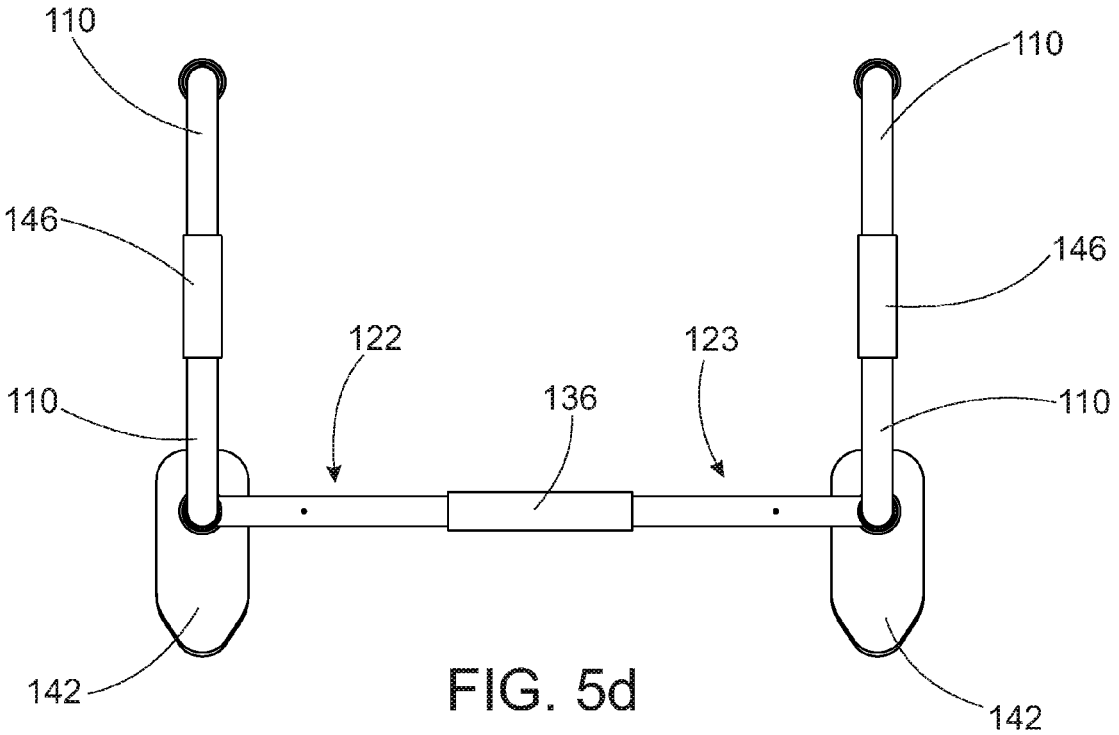
FIG. 5*d* is a top view of a foldable walker fitted with skis.

FIG. 5*c* is an enlarged view of a front leg with a front-leg ski extension 142. In some embodiments, ski extension 142 is interchangeably coupled to front leg 105, wherein a user of walker 100 may interchange ski extension 142 with an extension having wheel 141 or other attachments (not shown) on a front leg extension. FIG. 5*d* is a top view of a foldable walker fitted with ski extensions. Two hand grips 146 coupled to handle assembly 110 are also shown. When the walker needs to be folded, the skis must be removed.

Figure 6C:
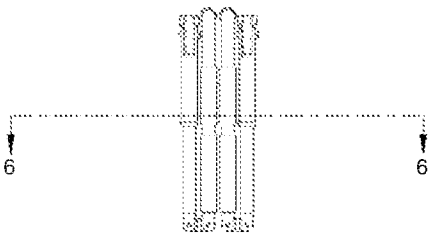
FIG. 6*c* is an enlarged sectional view taken through horizontal section line 6 of a first joint of a foldable walker in a fully folded configuration.
Figure 6B:
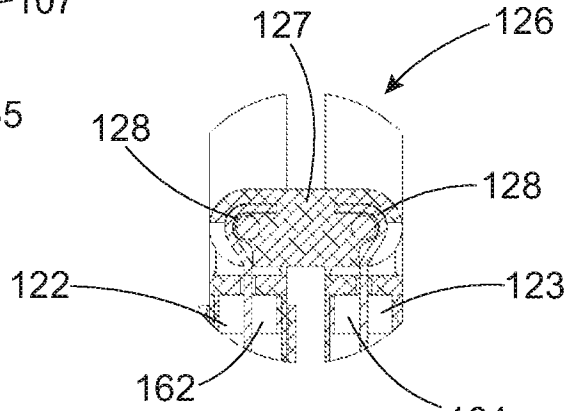
FIG. 6*b* is a sectional view taken through line 6 of a foldable walker in a fully folded configuration.
Figure 6A:
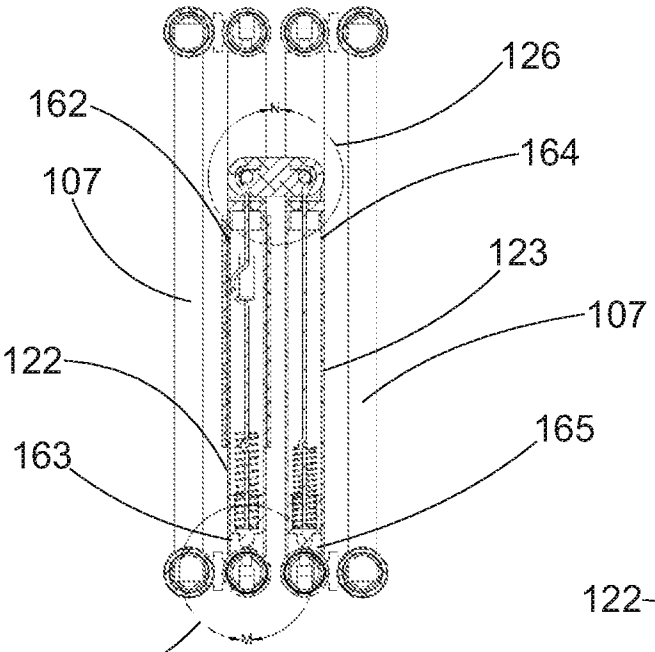
FIG. 6*a* is a front view of a foldable walker in a fully folded configuration showing horizontal section line 6.

FIG. 6*a* is a front view of a foldable walker in a fully folded configuration taken along horizontal section line 6-6 of FIG. 6*c*. Upon folding of front member 120 (FIG. 1*a*), second joint 126 hingedly moves wherein first bar 122 and second bar 123 of horizontal member 120 (FIG. 2) rotate into a generally parallel configuration, as shown in FIG. 6*c*. Horizontal section line 6-6 is taken midway through front member 120 (not shown; See FIG. 2), and depicts front member 120 (FIG. 1*a*) and joint 126, wherein joint 126 forces the front member 120 to fully collapse. FIG. 6*b* is a sectional view taken through line 6-6 of FIG. 6*c* of a foldable walker in a fully folded configuration, wherein second joint 126 is encircled.

FIG. 6*b* is an enlarged sectional view taken through horizontal section line 6-6 of FIG. 6*c* of a second joint 126 of a foldable walker in a fully folded configuration. FIG. 6*b* shows second joint 126 including a second hinge 127 coupled between a first end 162 of first bar 122 and first end 164 of second portion 123 to form horizontal member 121 (See FIG. 1*b*). Also shown is a first actuator 128. First actuator 128 engages hinge 127 under a condition wherein hinge 127 is in a fully open position, releasing hinge 127 and allowing rotation of first bar 122 and second bar 123. In the embodiment shown in the figures, and in other embodiments, first actuator 128 comprises a substantially rigid wire that releasably engages a pin of hinge 127. This is by way of example, and not meant to be limiting. Other actuator mechanisms are used in some embodiments.

FIG. 6*a* shows third joint 129 wherein second end 163 of first bar 122 is rotatably coupled to handle assembly 110 (not shown; See FIG. 1*b*). First actuator 128 engages hinge 127 under a condition wherein hinge 127 is in a fully open position, releasing hinge 127 and allowing rotation of first bar 122 and second bar 123 at hinge 127. In the embodiment shown in the figures, and in other embodiments, first actuator 128 comprises a wire that releasably engages a pin of hinge 127. This is by way of example, and not meant to be limiting. Other actuator mechanisms are used in some embodiments.

Figure 7A:
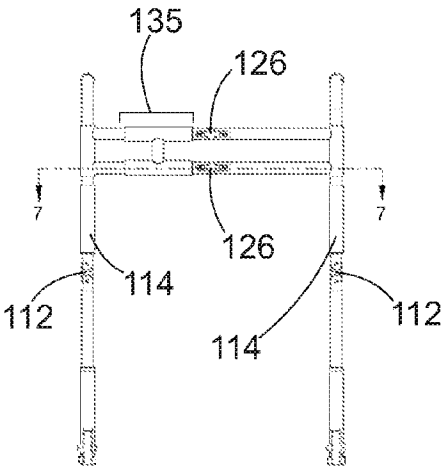
FIG. 7*a* is a front view of a foldable walker in a fully open configuration showing horizontal section line 7.

FIG. 7*a* is a front view of a foldable walker in a fully open configuration showing horizontal section line 7. Line 7 passes axially through horizontal member 120 (FIG. 1*a*). Second brace 135 is shown in open position 153 (FIG. 1*b*), exposing second joint 126. Additionally, first brace 114 is shown in open position 151 (FIG. 1*b*), exposing first joint 112.

Figure 7B:
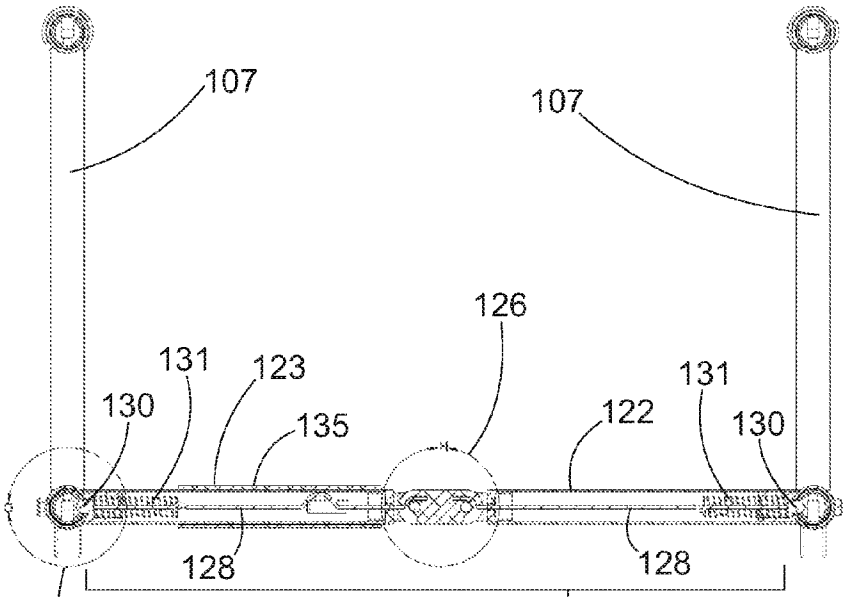
FIG. 7*b* is an enlarged sectional top view of a foldable walker in a fully open configuration taken through horizontal section line 7.
Figure 7C:
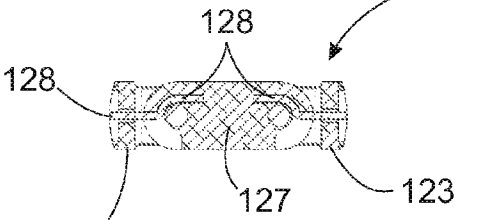
FIG. 7*c* is an enlarged sectional view of a second joint of a foldable walker in a fully open configuration taken through horizontal section line 7.
Figure 7D:
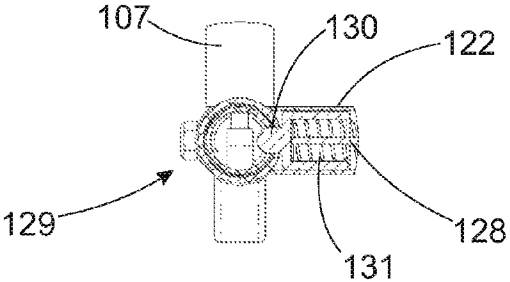
FIG. 7*d* is an enlarged sectional view of a third joint of a foldable walker in a fully open configuration taken through horizontal section line 7.

FIG. 7*b* is an enlarged sectional view of a third joint of a foldable walker in a fully open configuration taken through horizontal section line 7-7 of FIG. 7*a*. Horizontal member 120 includes first bar 122 and second bar 123 wherein section line 7-7 passes axially through horizontal member 120, revealing the components of first actuator 128 (FIG. 7*c*) and second actuator 130 (FIG. 7*d*). Details of second joint 126 are shown in FIG. 7*c*, which is an enlarged sectional view taken through line 7-7 of FIG. 7*a* of second joint 126. Details of third joint 129 are shown in FIG. 7*d*, which is an enlarged sectional view taken through line 7-7 of FIG. 7*a* of third joint 129.

In FIG. 7*c*, First actuator 128 engages second hinge 127, as described herein above. In some embodiments, first actuator 128 is coupled to a second actuator 130, as shown in FIG. 7*d*. Second actuator 130, in some embodiments, is a protrusion that engages an opening in handle assembly 110. A biasing member 131 biases second actuator to engage with handle assembly 110, in some embodiments. Biasing member 131, as shown in the drawing figures, is a spring, in some embodiments, such as, but not limited to a compression or expansion spring. This is by way of example and not meant to be limiting. Biasing member 131, in some embodiments, is a suitable biasing device, such as a spring plate or the like, that biases second actuator 130 to engage with a corresponding component of third hinge 129 (See FIG. 8*d*). First actuator 128 operates to provide forces on second actuator 130 by pulling second actuator away from handle assembly 110. Biasing member 131 automatically forces second actuator to engage a corresponding component in the handle assembly 110, such as a detent or a recess within the handle assembly 110.

Figure 8B:
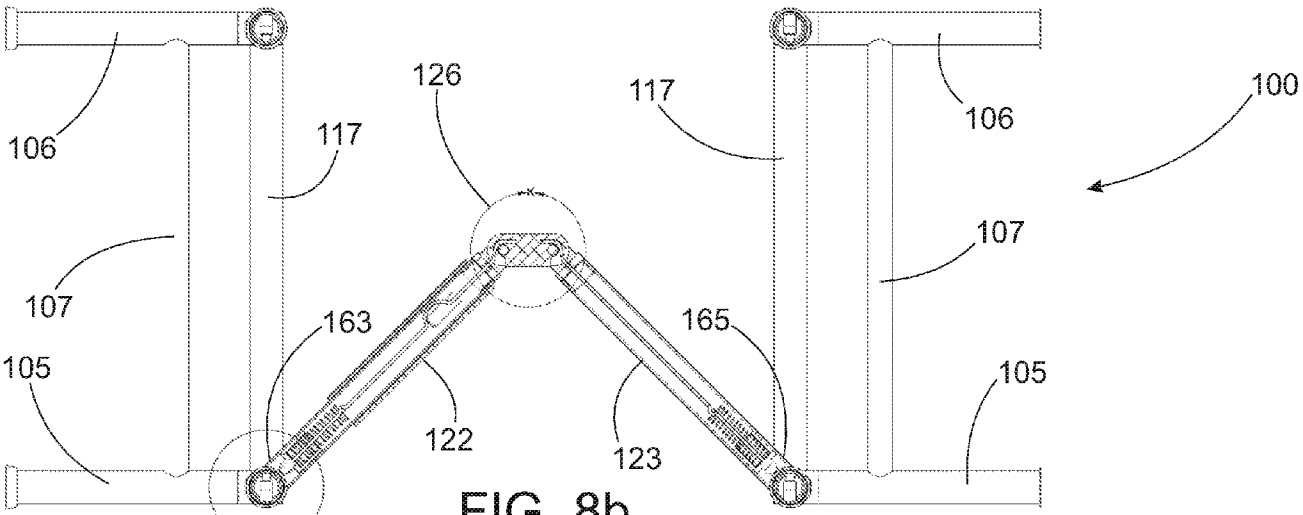
FIG. 8*b* is a sectional view of a foldable walker in a partially folded configuration taken through horizontal section line 8.
Figure 8C:
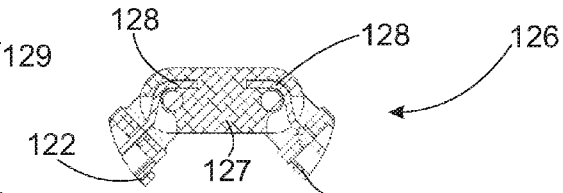
FIG. 8*c* is an enlarged sectional view of a second joint of a foldable walker in a partially folded configuration taken through horizontal section line 8.
Figure 8D:
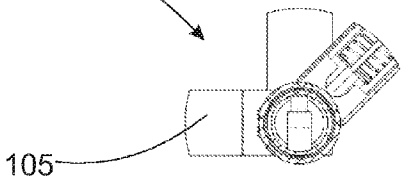
FIG. 8*d* is an enlarged sectional view of a third joint of a foldable walker in a partially folded configuration taken through horizontal section line 8.
Figure 8A:
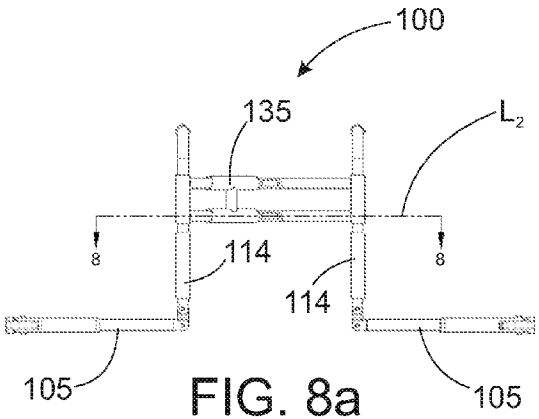
FIG. 8*a* is a front view of a foldable walker in a partially folded configuration showing horizontal section line 8.

FIG. 8*a* is a front view of a foldable walker in a partially folded configuration showing horizontal section line 8-8. FIG. 8*b* is a sectional view of a foldable walker in a partially folded configuration taken through horizontal section line 8-8 of FIG. 8*a*. FIG. 8*c* is an enlarged sectional view of a second joint of a foldable walker in a partially folded configuration; and FIG. 8*d* is an enlarged sectional view of a third joint of a foldable walker in a partially folded configuration. FIGS. 8*a-d* show additional detail of the folding mechanism along horizontal member 120. As shown, first bar 122 is coupled to second bar 123 by second hinge 127 of second joint 126. Second end 163 (FIG. 6*a*) of first bar 122 is hingedly coupled to handle assembly 110 by third hinge 134 at third joint 129, such that second end 163 of first bar 122 rotates about frame member 110 when second actuator 130 is disengaged from frame member 110, as shown by FIG. 8*d*. Second end 165 (FIG. 6*a*) of second bar 123 is hingedly coupled to handle assembly 110 by third hinge 134 of third joint 129, such that second end 165 of second bar 123 rotates about frame member 110 when second actuator 130 is disengaged from frame member 110, as shown by FIG. 8*d*.

Figure 9:
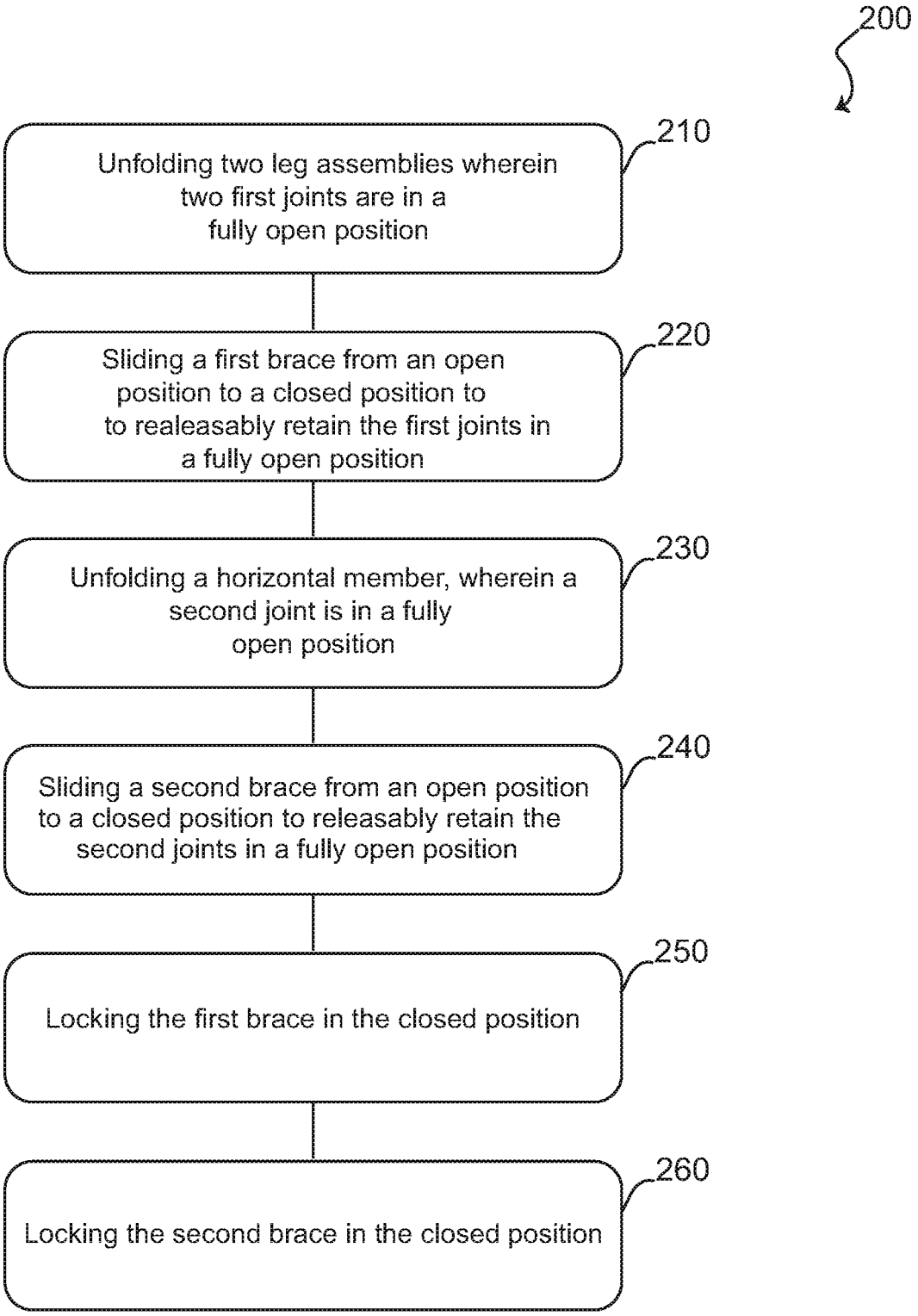
FIG. 9 is a flowchart depicting steps of a method for preparing a folding walker for use.

FIG. 9 is a flowchart showing steps of a method 200 of using a folding walker for use. Method 200 comprises a first unfolding step 210 comprising unfolding two leg assemblies wherein two first hinges are in a fully open position; a first sliding step 220 comprising sliding a first brace from an open position to a closed position to releasably retain the first joint in a fully closed position; a second unfolding step 230 comprising unfolding a horizontal member, wherein a second hinge is in a fully open position; and a second sliding step 240 comprising sliding a second brace from an open position to a closed sliding brace position to releasably retain the second joint in a fully open position.

In some embodiments, method 200 additionally comprises a first locking step 250 comprising locking the first brace in the closed position. In some embodiments, method 200 additionally comprises a second locking step 260 comprising locking the second brace in the closed position.

Figure 10:
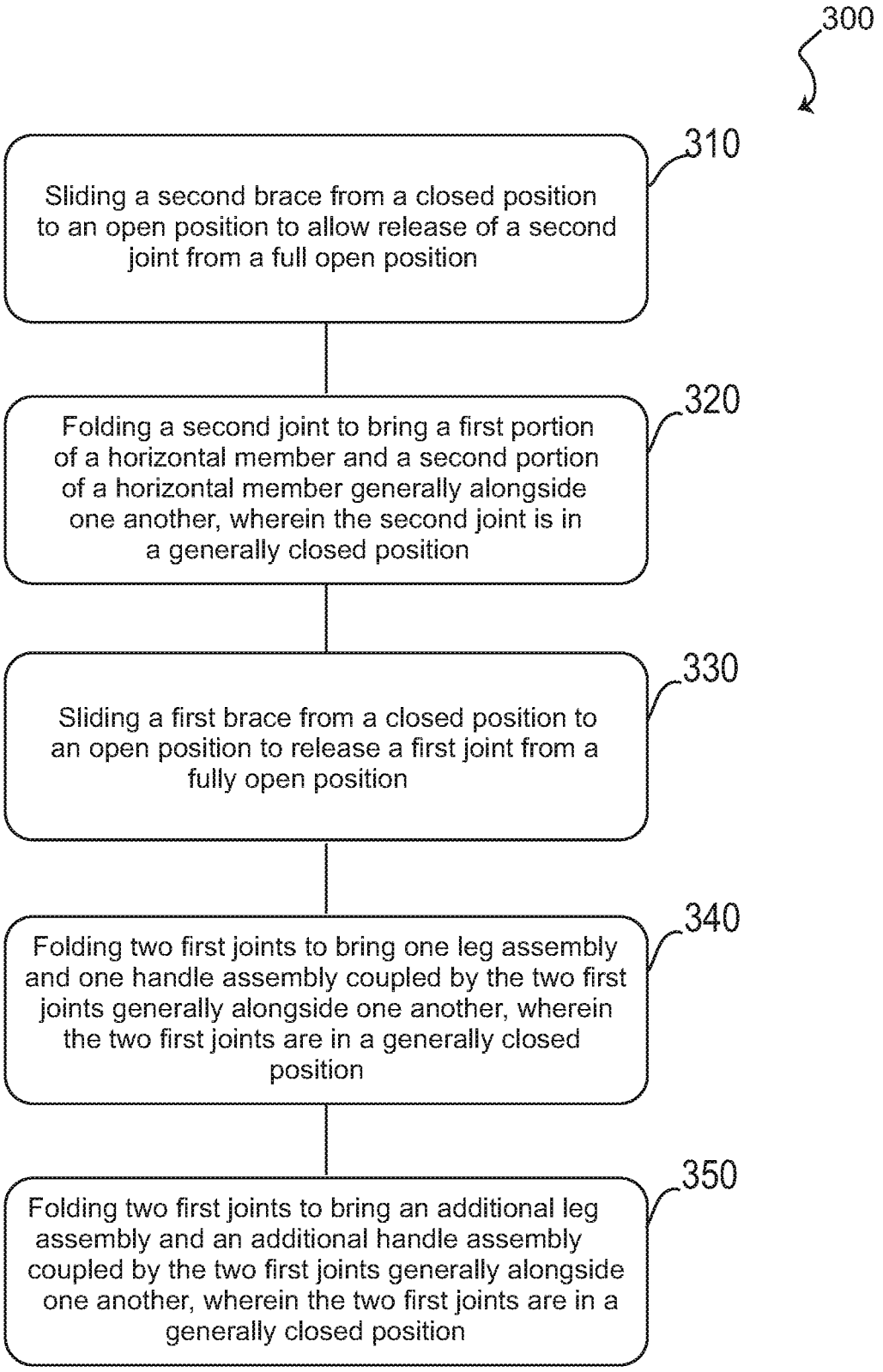
FIG. 10 is a flowchart depicting steps of a method for preparing a folding walker for non-use.

FIG. 10 is a flowchart showing steps of a method 300 of using a folding walker for non-use. Method 300, in some embodiments, comprises a first sliding step 310 comprising sliding a second brace from a closed position to an open position to allow release of a second joint from a full open position; a first folding step 320 comprising folding a second joint to bring a first bar(s) of a horizontal member and a second bar(s) of a horizontal member generally alongside on another, wherein the second joint is in a generally closed position; a second sliding step 330 comprising sliding a first brace from a closed position to an open position to release a first joint from a fully open position; a second folding step 340 comprising folding two first joints to bring one leg assembly and one handle assembly coupled by the two first joints generally alongside on another, wherein the two first joints are in a generally closed position; and a third folding step 350 comprising folding two first joints to bring an additional leg assembly and an additional handle assembly coupled to the two first joints generally alongside one another, wherein the two first hinges are in a generally closed position.

A folding walker, including methods of using the folding walker for use and methods of preparing the folding walker for non-use have been described. The folding walker folds in two separate planes, compressing both the overall width and overall height of the walker, greatly facilitating transport of storage of the folding walker by decreasing its footprint. Foldability in two separate planes, generally orthogonal to one another, solves the problem present in the prior are of transporting or storing bulky partially-collapsed walkers which are folded in one plane only.

The components defining any folding walker may be formed of any of many different types of materials or combinations thereof that can readily be formed into shaped objects provided that the components selected are consistent with the intended operation of a folding walker. For example, the components may be formed of: rubbers (synthetic and/or natural) and/or other like materials; glasses (such as fiberglass) carbon-fiber, aramid-fiber, any combination thereof, and/or other like materials; polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; composites and/or other like materials; metals, such as zinc, magnesium, titanium, copper, iron, steel, carbon steel, alloy steel, tool steel, stainless steel, aluminum, any combination thereof, and/or other like materials; alloys, such as aluminum alloy, titanium alloy, magnesium alloy, copper alloy, any combination thereof, and/or other like materials; any other suitable material; and/or any combination thereof.

Furthermore, the components defining any folding walker may be purchased pre-manufactured or manufactured separately and then assembled together. However, any or all of the components may be manufactured simultaneously and integrally joined with one another. Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, any combination thereof, and/or the like for example, depending on, among other considerations, the particular material forming the components. Other possible steps might include sand blasting, polishing, powder coating, zinc plating, anodizing, hard anodizing, and/or painting the components for example.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above.

The invention claimed is:

1. A method of using a folding walker, the method comprising:

unfolding two leg assemblies wherein two first joints are in a fully open position;

sliding a first brace from an open position to a closed position to releasably retain the first joints in a fully open position, the first sliding brace comprising:

two first sleeves, wherein each first sleeve is slidably coupled to a handle assembly and a leg assembly; and a first strut coupled between the two first sleeves;

unfolding a horizontal member, wherein a second joint is in a fully open position; and sliding a second brace from an open position to a closed position to releasably retain the second joints in a fully open position, the second brace comprising:

two second sleeves, wherein one second sleeve is coupled to a first portion of the horizontal member and the other second sleeve is coupled to a second portion of the horizontal member; and a second strut coupled between the two second sleeves.

2. The method of claim 1, further comprising locking the first brace in the closed position; and locking the second brace in the closed position.

3. The method of claim 1 further comprising sliding the second brace from the open position to the closed position to allow release of the second joint from a fully open position;

folding the second joint to bring a first bar of the horizontal member and a second bar of the horizontal member coupled to each other by the second joint adjacent one another, wherein the second joint is in a closed position;

sliding the first brace from the closed position to the open position to release the first joints from a fully open position;

folding the two first joints to bring one leg assembly and one handle assembly coupled by the two first joints adjacent one another, wherein the two first joints are in a closed position; and folding two first joints to bring an additional leg assembly and an additional handle assembly coupled to each other by the two first joints adjacent one another, wherein the two first joints are in a closed position.

* * * * *